US005329346A

United States Patent [19]

Suzuki et al.

[11] Patent Number: 5,329,346

[45] Date of Patent: Jul. 12, 1994

[54] MULTI-COLOR IMAGE FORMING SYSTEM

[75] Inventors: Hiroyuki Suzuki, Machida; Kenichiro Waki, Kawasaki, both of Japan

[73] Assignee: Canon Kabushiki Kaisha, Tokyo, Japan

[21] Appl. No.: 946,568

[22] Filed: Sep. 18, 1992

[30] Foreign Application Priority Data

Sep. 20, 1991 [JP] Japan ..... 3-268969
Oct. 18, 1991 [JP] Japan ..... 3-298123

[51] Int. Cl.[5] ..... G03G 15/01
[52] U.S. Cl. ..... 355/326 R; 355/210
[58] Field of Search ..... 355/200, 210, 244, 326, 355/327, 326 R; 346/160, 153.1

[56] References Cited

U.S. PATENT DOCUMENTS 4,866,481 9/1989 Yamada et al. ..... 355/326 X
4,866,486 9/1989 Higashio et al. ..... 355/326
5,066,972 11/1991 Nagata et al. ..... 355/27
5,175,570 12/1992 Haneda et al. ..... 346/160

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

The present invention aims to solve problems caused in forming multiple images on the same transfer sheet in response to an original by using black toner and color toner, and prevents a shade of the original from being developed by the color toner which results in the indistinct copy image. To this end, according to the present invention, an area developed by the color toner is made narrower than an area developed by the black toner.

11 Claims, 9 Drawing Sheets

MULTI-COLOR IMAGE FORMING SYSTEM

BACKGROUND OF THE INVENTION

1. Field of the Invention

The present invention relates to an image forming system such as an electrophotographic copying machine, and more particularly, it relates to a multi-color image forming system for effecting the multi-color printing. More specifically, the present invention relates to a multi-color image forming system wherein a multi-color image is formed with at least two colors during one copy cycle, by forming a first electrostatic latent image on a uniformly charged electrostatic latent image bearing member by the first exposure, and then by developing the electrostatic latent image with developer (referred to as "toner" hereinafter) as a first toner image, then by charging the image bearing member again, then by forming a second electrostatic latent image on the image bearing member by the second exposure, and then by developing the second latent image with toner having the different color from the first one as a second toner image.

2. Related Background Art

Conventionally, electrophotographic and electrostatic image forming systems have been used terminal printers of information processing equipments such as a computer, facsimile, CAD and the like. Such a printer can obtain a record image by writing an information signal on a photosensitive member as an electrostatic latent image bearing member by a laser beam, LED, LCD or the like, then by visualizing the information signal as a toner image by a developing device, then by transferring the toner image onto a transfer sheet, and then by fixing the transferred image to the transfer sheet by a fixing device. In the past, the record image was usually a mono-color image.

However, recently, since the record images have been more clear and the information could have been more easily understood, printers which can obtain a color record image having two or more colors (for example, can indicate calculated values and data values with a color different from a color of the format or can indicate a portion of an image outputted by the CAD with a color different from a color of the other image) have been requested. Such electrophotographic apparatuses which can obtain the color image having two or more colors are mainly divided into the type that an image portion is exposed (here, "image exposure" wherein the light is applied to portions corresponding to dark portions of an original image) and then is subjected to the reversal development (referred to as "image exposure/reversal development type" hereinafter) and the type that a non-image portion in exposed (background exposure) and is subjected to the normal development (referred to as "background exposure/-normal development type" hereinafter).

First of all, the image exposure/reversal development type will briefly be explained with reference to FIG. 4. In FIG. 4, the reference numeral 1 denotes a drum-shaped (or belt-shaped) photosensitive member as an image bearing member rotated in a direction shown by the arrow a in FIG. 4 and having a photoconductive layer made of amorphous silicone or the like. Incidentally, the change in surface potential of the photosensitive member (photosensitive body) during the following steps is shown in FIGS. 6 to 11. First of all, the photosensitive member 1 is uniformly charged to for example +400 volts (FIG. 6) by a first charger 2, and then is exposed by the first image exposure 3.

The first exposure 3 is effected by a first laser beam emitted from a first semi-conductor laser 11 as a light source and modulated in response to a first image signal. The first laser beam is polarized by a polygonal mirror 13 rotated at a constant number of rotation by a motor 14 and then passes through a focusing lens 15 to reach a reflection mirror 16. Then, the first laser beam reflected by the reflection mirror 16 luster-scans the surface of the photosensitive member 1, so that the surface potential of the exposed portion is attenuated to for example +100 volts (FIG. 7), thereby forming a first latent image.

The first latent image is developed by a first developing device 4, for example, containing black one-component magnetic toner charged positively. A first reversal development of the first latent image is effected by applying to the first developing device 4 a bias voltage obtained for example by overlapping a DC voltage of +340 V to an AC voltage of 2000 Hz, 1300 Vpp (FIG. 8). The potential of a first toner image T1 (FIG. 8) formed in this way becomes about +200 volts since it is increased by the toner charge by about +100 volts.

After the first reversal development, the photosensitive member 1 is charged again by a second charger 5, thereby increasing the potential of the first toner image to +420 volts, for example (FIG. 9). Then, the photosensitive member 1 is exposed by the second exposure 6. The second exposure 6 is effected by a second laser beam emitted from a second semiconductor laser 12 as a light source and modulated in response to a second image signal. The second laser beam is polarized by a rotating polygonal mirror 13 and then passes through a focusing lens 15 to luster-scan the surface of the photosensitive member 1, so that the potential of the exposed portion is attenuated to for example +60 volts (FIG. 10), thereby forming a second latent image.

The second latent image is developed by a second developing device 7, for example, containing red one-component non-magnetic toner charged positively. A second reversal development of the second latent image is effected by applying to the second developing device 7 a bias voltage obtained for example by overlapping a DC voltage of +400 V to an AC voltage of 1600 Hz, 1300 Vpp (FIG. 8), thereby forming a second toner image T2 (FIG. 11).

The two different color toner images T1, T2 formed on the photosensitive member 1 in this way are transferred onto a transfer sheet P by a transfer device 8 and then are fixed to the transfer sheet by a fixing device 9. On the other hand, the residual toner remaining on the photosensitive member 1 is removed and collected by a cleaning device 10.

Next, the background/normal development type will be explained also with reference to FIG. 4. Incidentally, the change in surface potential of the photosensitive member 1 during the following steps is shown in FIGS. 12 to 17.

In this background/normal development type, after the photosensitive member 1 is uniformly charged to for example +400 volts by a first charger 2 (FIG. 12), a non-image portion is exposed by the first exposure 3. The first exposure 3 is effected by a first laser beam emitted from a first semi-conductor laser 11 as a light source and modulated in response to a first image signal. The first laser beam is polarized by a polygonal mirror 13 rotated at a constant number of rotations by a motor 14 and then passes through a focusing lens 15 to reach a reflection mirror 16. Then, the first laser beam reflected by the reflection mirror 16 luster-scans the surface of the photosensitive member 1, so that the surface potential of the exposed portion is attenuated to for example +40 volts (FIG. 13), thereby forming a first reversal latent image.

The first latent image is developed by a first developing device 4, for example, containing black one-component magnetic toner charged negatively. A first normal development of the first latent image is effected by applying to the first developing device 4 a bias voltage obtained for example by overlapping a DC voltage of +110 V to an AC voltage of 2000 Hz, 1300 Vpp (FIG. 14). The potential of a first toner image T1 (FIG. 14) formed in this way becomes about +320 volts since it is decreased by the toner charge by about +80 volts.

After the first normal development, the photosensitive member 1 is charged again by a second charger 5, thereby increased the potential of the first toner image to +420 volts, for example (FIG. 15). Then, the photosensitive member 1 is exposed by the second exposure 6. The second exposure 6 is effected by a second laser beam emitted from a second semiconductor laser 12 as a light source and modulated in response to a second image signal. The second laser beam is polarized by a rotating polygonal mirror 13 and then passes through a focusing lens 15 to luster-scan the surface of the photosensitive member 1, so that the potential of the exposed portion is attenuated to for example +40 volts (FIG. 16), thereby forming a second reversal latent image.

The second latent image is developed by a second developing device 7, for example, containing red one-component non-magnetic toner charged negatively. A second normal development of the second latent image is effected by applying to the second developing device 7 a bias voltage obtained for example by overlapping a DC voltage of +150 V to an AC voltage of 1600 Hz, 1300 Vpp (FIG. 17), thereby forming a second toner image T2.

The two different color toner images T1, T2 formed on the photosensitive member 1 in this way are simultaneously transferred onto a transfer sheet P by a transfer device 8 and then are fixed to the transfer sheet by a fixing device 9. On the other hand, the residual toner remaining on the phtosensitive member 1 is removed and collected by a cleaning device 10.

It is surely possible to obtain the two color image according to the above-mentioned exposure/development types. However, as a result that the image was obtained by the above conventional exposure/development technique, it was found that, at the peripheral zone of the copied or formed image, the color toner was adhered at areas where any images should not have exist essentially, with the result that the copied two color image was not distinct. Such indistinct image was formed not only by the reversal development but also by the normal development. Several reasons seems to be considered. For example, particularly, in case of a thicker original, when the original rested on an original support is read by a scanner to convert image information into an image signal, a shade is likely to occur at a peripheral area of the original, with the result that the shade is also converted into the image signal (particularly, although depending upon color discriminating techniques, such shade is likely to be discriminated as a color signal). If the color toner is adhered to the peripheral zone of the image, the image will be indistinct considerably.

SUMMARY OF THE INVENTION

The present invention aims to eliminate the above-mentioned conventional drawbacks, and an object of the present invention is to provide an image forming system which can obtain a multi-color image with high quality by preventing color toner from adhering to a peripheral zone of the image.

To achieve the above object, a color image forming system according to the present invention comprises an electrophotographic photosensitive member, a latent image forming means for forming an electrostatic latent image in response to an original image read by an original reading means, a first developing means for containing black toner and adapted to develop the electrostatic latent image formed on the photosensitive member, and a second developing means for containing color toner and adapted to develop the electrostatic latent image formed on the photosensitive member. A first area on the photosensitive member developed by the first developing means is wider than a second area on the photosensitive member developed by the second developing means.

DESCRIPTION OF THE PREFERRED EMBODIMENTS

Figure 1:
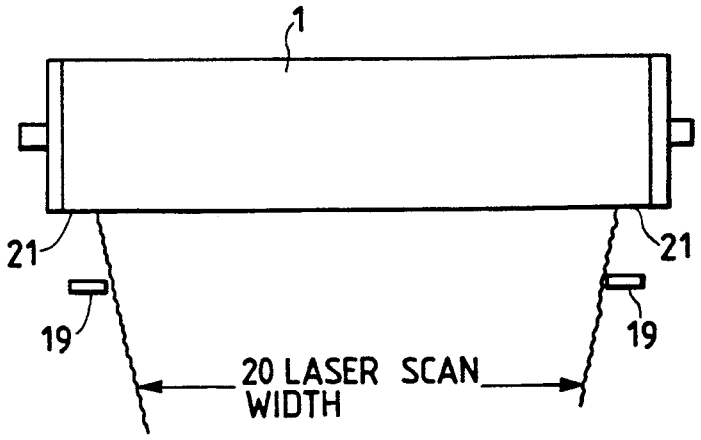
FIG. 1 is a plan view showing a laser scan width with respect to a photosensitive member in a color mode, according to a preferred embodiment of the present invention.

The present invention will now be explained in connection with embodiments thereof with reference to the accompanying drawings. Incidentally, in the drawings, the same reference numerals as those used in the explanation of the conventional techniques are used, except for the particular definition.

Figure 2:
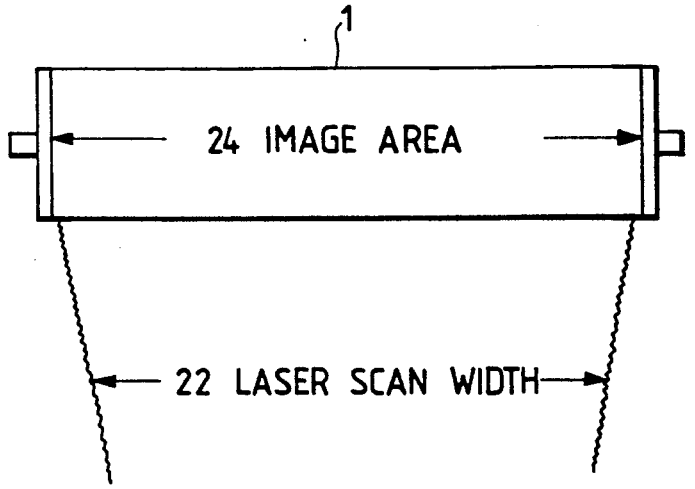
FIG. 2 is a plan view showing a laser scan width with respect to a photosensitive member in a black mode, according to a preferred embodiment of the present invention.

First of all, a first embodiment of the present invention will be explained. In the first embodiment relating to the image exposure/reversal development type, a semi-conductor laser is used as an image exposure means. FIG. 1 is a view showing a laser scan width 20 with respect to a photosensitive member 1 when the image exposure is effected in a color mode. In this case, the image exposure at end portions 21 of the photosensitive member 1 is regulated by providing shield plates 19 between the photosensitive member 1 and the image exposure means. FIG. 2 is a view showing a laser scan width 22 with respect to a photosensitive member 1 when the image exposure is effected in a black mode.

Figure 9:
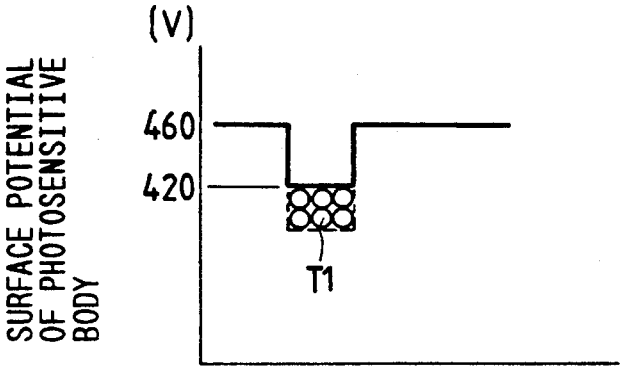
Figure 10:
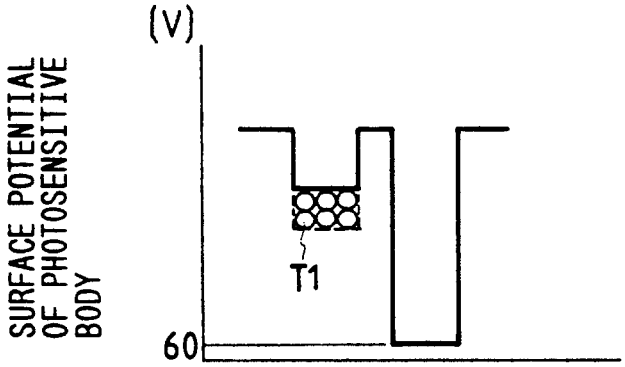
Figure 11:
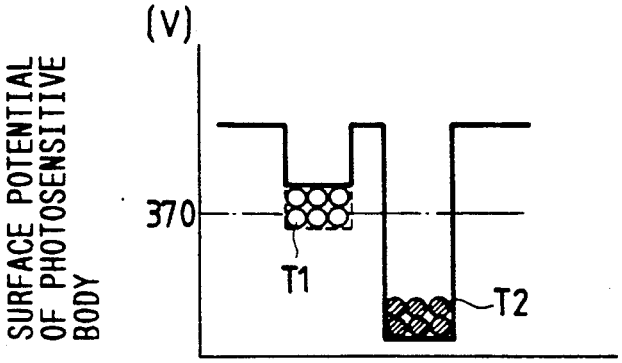

Now, the operation in this embodiment wherein the shield plates 19 are used at the image exposure portion in the color mode will be explained with reference to FIG. 5 and FIGS. 6 to 11. First of all, the photosensitive member 1 is uniformly charged to +400 volts (FIG. 6) by a charger 2. Thereafter, a latent image of +100 volts is formed by the image exposure 3 (FIG. 7), and then the reversal development is effected by a first development device 4. The first development device 4 contains black one-component magnetic toner as developer, as in the conventional case, and serves to form black image information (black toner image) on the photosensitive member 1. As shown in FIG. 2, the laser scan width 22 covers substantially the whole image area 24. Then, the photosensitive member 1 and the toner image T1 thereon are charged to +460 volts and +420 volts, respectively, by a charger 5 (FIG. 9). The color image information is image-exposed on the photosensitive member 1 by the second image exposure 6, and the reversal development is effected by a second developing device 7 to obtain a color image. The second developing device 7 contains color one-component non-magnetic toner (other than black), and, as shown in FIG. 1, the laser scan width 20 for the color image is made narrower than that for the black image by the provision of the shield plates 19.

The two color images developed on the photosensitive member 1 in this way are transferred onto a transfer sheet P by a transfer charger 8 and then is fixed to the transfer sheet by a fixing device 9. In this way, by providing the shield plates 19 between the photosensitive member 1 and the image exposure means, since any latent image is not formed at a peripheral zone of the image area 24, even if a shade of the edge or end of the original is discriminated as the color signal, it is possible to prevent the color toner from adhering to the peripheral zone of the image. Accordingly, the image obtained by this embodiment is remarkably superior to the image obtained by the conventional techniques.

The degree that the laser scan width 20 for the color mode becomes shorter than the laser scan width 22 for the black mode depends upon the property of the image forming system used. For example, in consideration of the possibility that the sliding cracks or scratches are generated at end portions of the photosensitive member land the possibility that the color information exists at end zones of the original, it is preferable that the laser scan with 20 for the color mode is set to shorten by about 3–5 mm from both ends of the image area 24, respectively, and the shield plates 19 are arranged accordingly.

Figure 3:
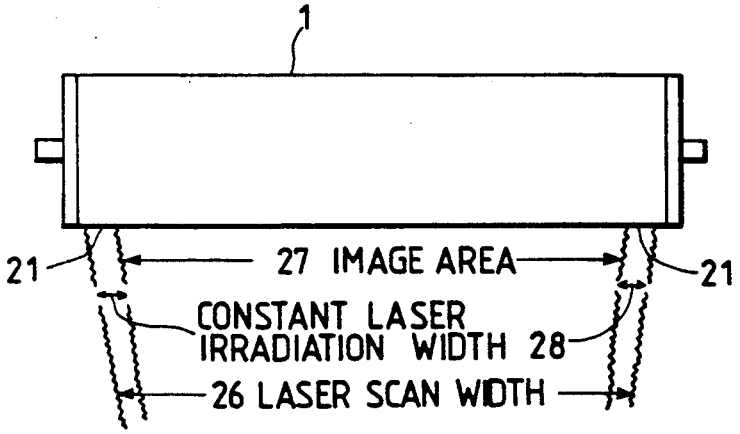
FIG. 3 is a plan view showing a laser scan width and a constant laser irradiation width with respect to a photosensitive member in a color mode.
Figure 12:
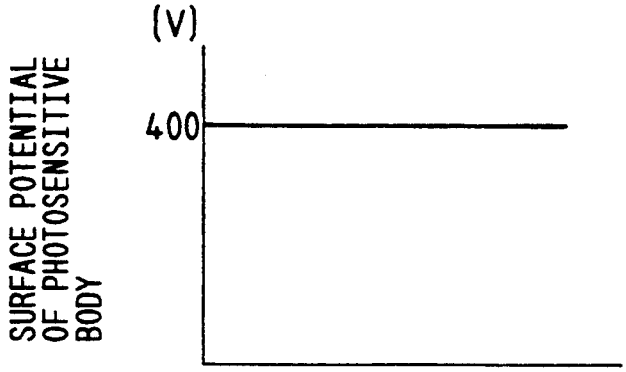
Figure 13:
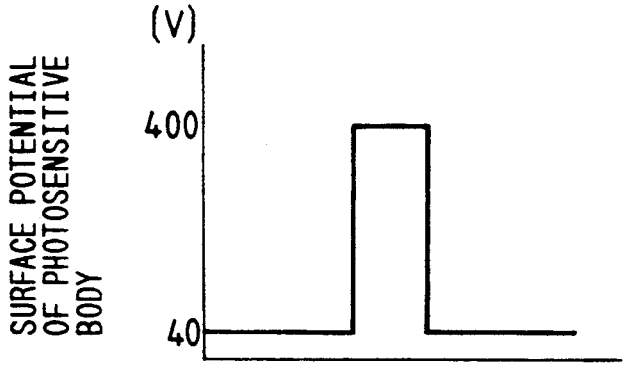
Figure 14:
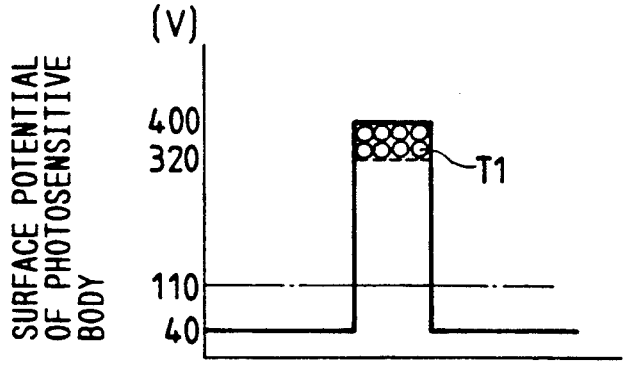

Next, a second embodiment of the present invention will be explained. This embodiment concerns to the background exposure/normal development type and utilizes a semi-conductor laser as the exposure means. FIG. 2 shows the laser scan width 22 for the photosensitive member 1 in the black image exposure mode. FIG. 3 shows a laser scan width 26 for the photosensitive member 1 in the color image exposure mode. In this case, the image signal is always irradiated on end portions 21 of the photosensitive member 1 by the laser. Now, the operation of the second embodiment wherein the laser beams are always irradiated on the both end portions 21 of the photosensitive member 1 in the color image exposure mode in this way will be explained with reference to FIG. 4 and FIGS. 12 to 17. First of all, the photosensitive member 1 is uniformly charged to +400 V (FIG. 12) by a charger 2, and then a reversal latent image is formed by the image exposure to the background (FIG. 13).

Figure 15:
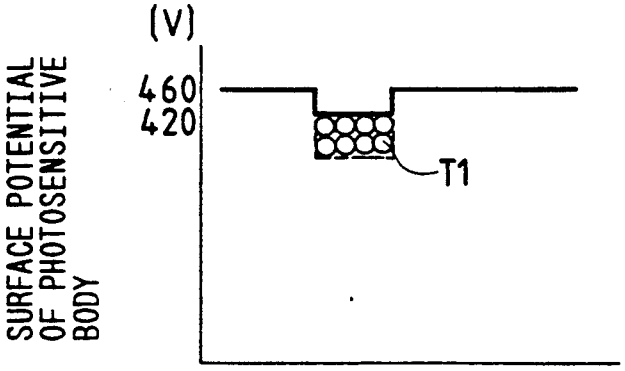
Figure 16:
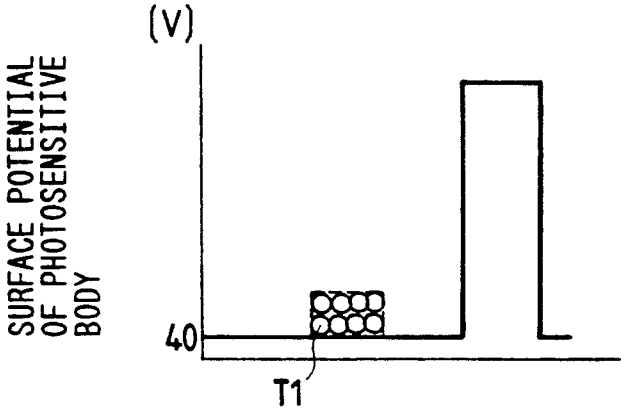
Figure 17:
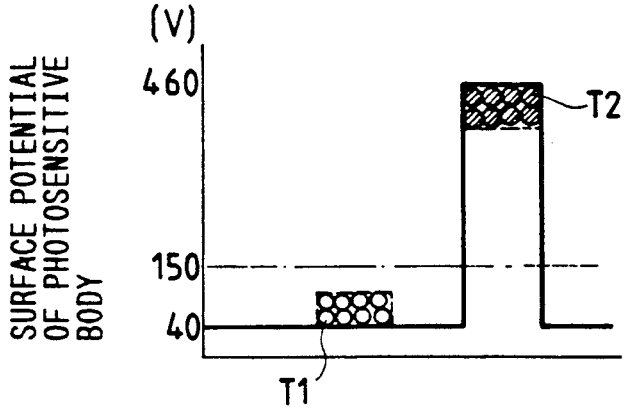

Then, the normal development is effected by a first development device 4 with toner charged negatively. The first developing device 4 contains black one-component magnetic toner as developer, as in the conventional case, and serves to form black image information (black toner image) on the photosensitive member 1. In this case, as shown in FIG. 2, the laser scan width 22 covers substantially the whole image area 24. Then, the photosensitive member 1 and the toner image T1 thereon are charged to +460 volts and +420 volts, respectively, by a charger 5 (FIG. 15). The color image information is written on the photosensitive member 1 with the background exposure by the second image exposure 6 as a reversal latent image, and the normal development is effected by a second developing device 7 to obtain a color image. The second developing device 7 contains color one-component non-magnetic toner (other than black), and, as shown in FIG. 3, an image area 27 made narrower than that for the black image by a constant laser irradiation width 28 by being always irradiated by the laser. The two color images developed on the photosensitive member 1 in this way are transferred onto a transfer sheet P by a transfer charger 8 and then is fixed to the transfer sheet by a fixing device 9.

In this way, by always irradiating the laser on the both end portions 21 of the photosensitive member 1, since the surface potential of the end portions 21 of the photosensitive member 1 is reduced sufficiently, even if a shade of the edge or end of the original is discriminated as the color signal, it is possible to prevent the color toner from adhering to the peripheral zone of the image. Accordingly, the image obtained by this embodiment is remarkably superior to the image obtained by the conventional techniques.

The degree that the image area for the color mode becomes shorter that for the black mode depends upon the property of the image forming system used. For example, in consideration of the possibility that the sliding cracks or scratches are generated at end portions 21 of the photosensitive member 1 and the possibility that the color information exists at end zones of the original, it is preferable that the constant laser irradiation width 28 and the image signal are set so as to shorten smaller than the image area for the color image by about 3–5 mm from both ends of the image area 24 for the black image, respectively.

Incidentally, in the above embodiments, while an example that the black image is formed as a first image and then the color image is formed as a second image on the photosensitive member 1 was explained, the present invention is not limited to this example. For example, the color image may be formed as a first image without adhering the toner to the peripheral zone of the image by regulating the image area of the color image, and then the black image may be formed as a second image on the whole surface area of the photosensitive member 1. In this case, since the color image is firstly formed, each of the finished images is not influenced upon the black toner, and thus, is excellent.

Further, in the above embodiments, while the image forming system having two charges, two exposure means and two developing means, and, thus, capable of providing the two color image was explained, the present invention is not limited to this image forming system, but may be applied to any image forming systems having three or more chargers, exposure means and developing means, and, thus, capable of providing a three or more color image. For example, an image forming system may be designed so that a black image is formed as a first image, a red image is formed as a second image and a blue image is formed as a third image. In this case, when the image exposure operations are effected to form the red and blue images, the laser scan widths are regulated, respectively, by providing the shield plates 19 between the photosensitive member 1 and the image exposure means as shown in FIG. 1 so that the toner is not adhered to the peripheral zone of each image. Further, the laser scan widths for the second and third color images may be the same or may be different more or less for obtaining substantially the same technical effect. However, the laser scan widths for the second and third color images should be shorter than that for the first black color image.

Further, the developing method is not limited to the above-mentioned embodiments, but a developing method utilizing two-component toner or a developing method having a toner supplying elastic blade may be used.

Furthermore, as for the image exposure means, LED arrays, liquid crystal shutters or the like may be used, in place of the semi-conductor lasers.

According the aforementioned embodiments, with the arrangement as mentioned above, it is possible to prevent the color toner from adhering to the peripheral zone of the image, thus providing a multi-color image with high quality.

Next, a multi-color image forming system according to a third embodiment of the present invention will be explained. In this embodiment, developing devices embodied as ones used with the image forming system shown in FIG. 4 will be fully described.

Figure 18:
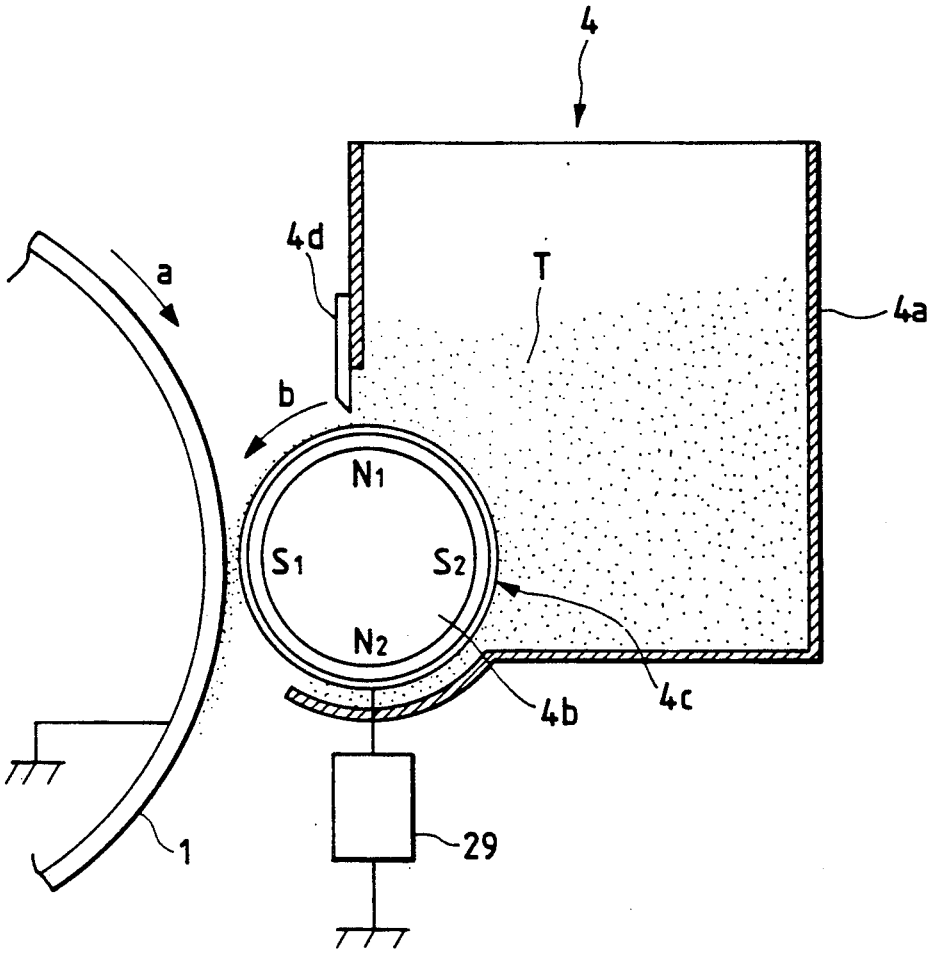
FIG. 18 is an elevational sectional view of a developing device according to an embodiment of the present invention.

FIG. 18 shows an example of a schematic construction of a developing device 4 or 7 applicable to the present invention. Since the developing devices 4 and 7 have the same construction, only the developing device 4 will be fully explained hereinbelow. The developing device 4 comprises a toner container 4*a* for containing toner therein, and a developing sleeve (toner carrying member) 4*c* incorporating a magnet roller 4*b* therein and rotatable supported within the toner container 4*a*. The developing sleeve 4*c* serves to carry or hold the toner thereon. A toner layer thickness regulating blade 4*d* serves to regulates a thickness of a toner layer formed on the developing sleeve 4*c*. The toner layer passed through the regulating blade 4*d* is fed, by the developing sleeve 4*c*, to a developing station opposed to the photosensitive member 1, where the electrostatic latent image on the photosensitive member 1 is developed by the toner carried on the developing sleeve 4*c*. Although the toner carrying member 4*c* is normally constituted by the developing sleeve, it may be formed as a toner carrying belt.

Since the design and function of the developing device is well-known a further detailed explanation will be omitted.

Figure 4:
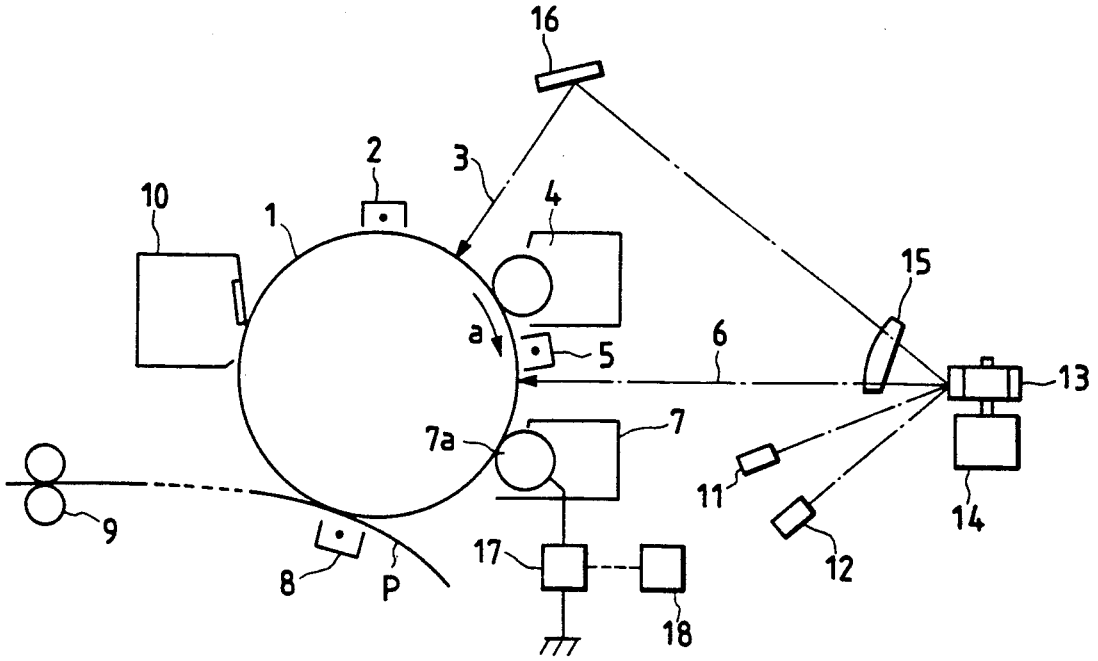
FIG. 4 is a schematic constructional view of an image forming system of a conventional case.
Figure 5:
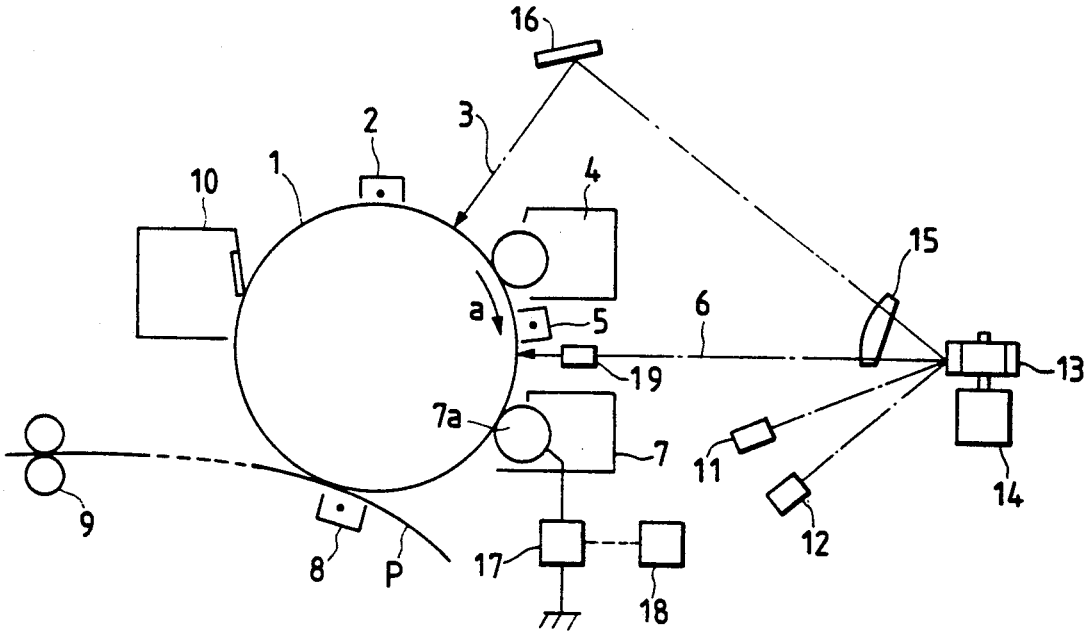
FIG. 5 is a schematic constructional view of an image forming system according to an embodiment of the present invention.
Figure 6:
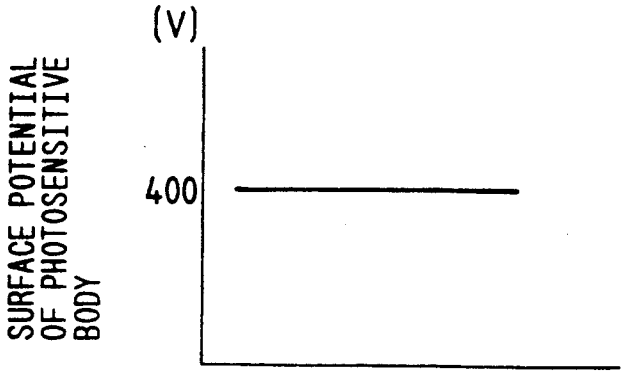
FIGS. 6 to 17 are graphs showing a surface potential of a photosensitive member, according to an embodiment of the present invention.
Figure 7:
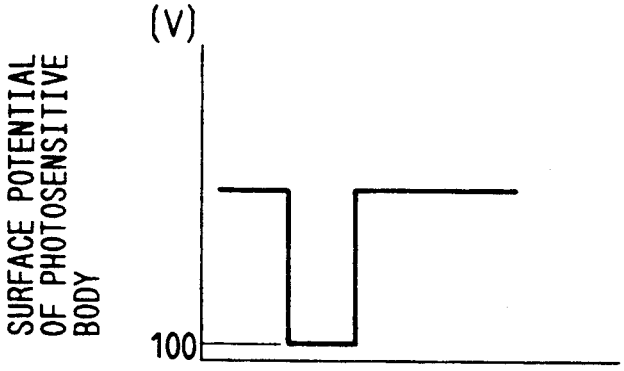
Figure 8:
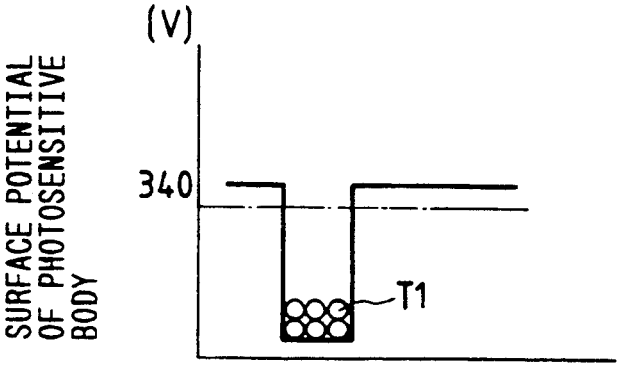
Figure 19:
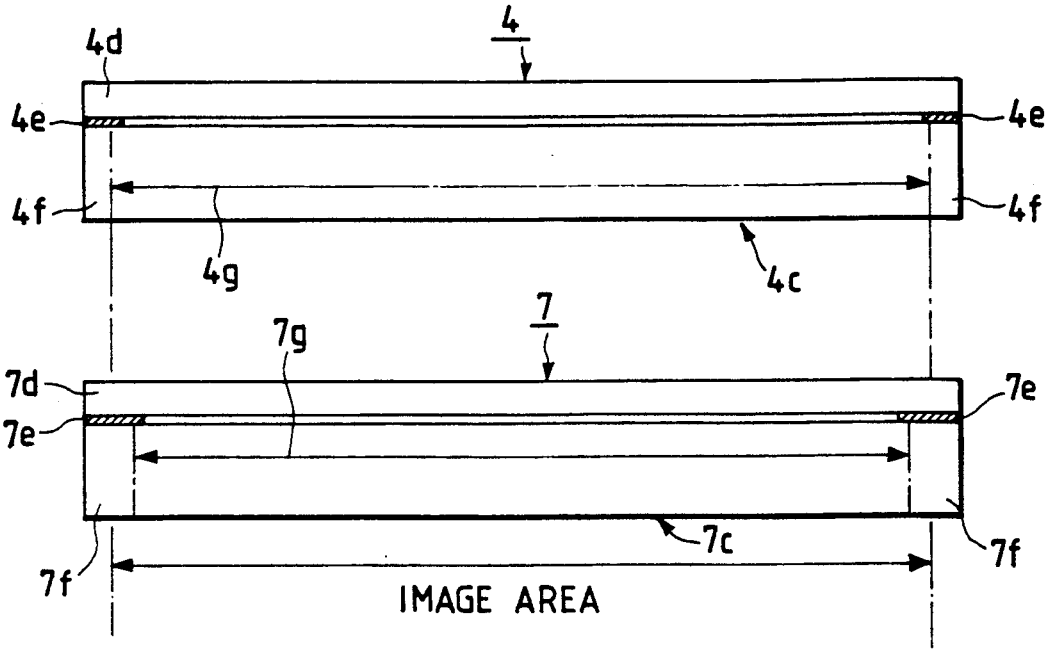
FIG. 19 is a front elevational view of a developing device according to an embodiment of the present invention, showing a relation between a blade for regulating a thickness of a developer layer, end seal members arranged on both ends of first and second developing sleeves, developer non-applying areas and developer carrying areas of the developing sleeves.

FIG. 19 is a view of the first and second developing devices 4, 7 shown in FIG. 4 looked at from a location where the photosensitive member 1 is disposed, and illustrates the relation between the toner layer thickness regulating blades 4*d*, 7*d*, end seal members 4*e*, 7*e* provided on both ends of the first and second developing sleeves 4*c*, 7*c*, toner non-applying areas 4*f*, 7*f*, and areas 4*g*, 7*g* capable of actually carrying the toner.

As shown in FIG. 19, the toner carrying area 4*g* of the first developing device 4 has a width substantially the same as that of the image area; whereas, the toner carrying area 7*g* of the second developing device 7 has a width shorter than that of the toner carrying area 4*g* of the first developing device 4. Incidentally, the toner carrying area 4*g* on the developing sleeve 4*c* covers substantially the whole image area. Further, the toner carrying area 7*g* of the developing sleeve 7*c* of the second developing device 7 is shorter than the toner carrying area 4*g* of the first developing device 4 and the image area.

The two color images developed on the photosensitive member 1 by such first and second developing devices 4, 7 are transferred onto a transfer sheet P by a transfer charger 8 and then are fixed to the transfer sheet by a fixing device 9, as in the aforementioned embodiments.

With this arrangement, it is possible to prevent the second color toner from adhering to the peripheral zone of the image. Particularly, as mentioned above, even when the AC bias voltage is applied to the first developing device 4, it is possible to the scattering of the toner and to prevent the black toner escaped from the end of the first developing device 4 from entering into the second developing device 7. Further, it is possible to prevent the contamination of the second charger 5 and to prevent the cracks (easily generated at both end portions of the photosensitive member 1) from being developed by the color toner, thereby providing tht high quality image having the good appearance. The degree that the toner carrying area 7*g* of the second developing device 7 becomes shorter than the toner carrying area 4*g* of the first developing device 4 depends upon the property of the image forming system used. For example, in consideration of the possibility that the sliding cracks are generated at the end portions of the photosensitive member 1 and the possibility that the color information exists at end zone of the original, it is preferable that the toner carrying area 7g is set to shorten smaller than the image area by about 3–5 mm from both ends of the latter, respectively.

Incidentally, the developing method is not limited to the above-mentioned embodiments, but a developing method utilizing two-component toner or a developing method having a toner supplying elastic blade may be used.

Next, a fourth embodiment of the present invention will be explained.

Figure 20:
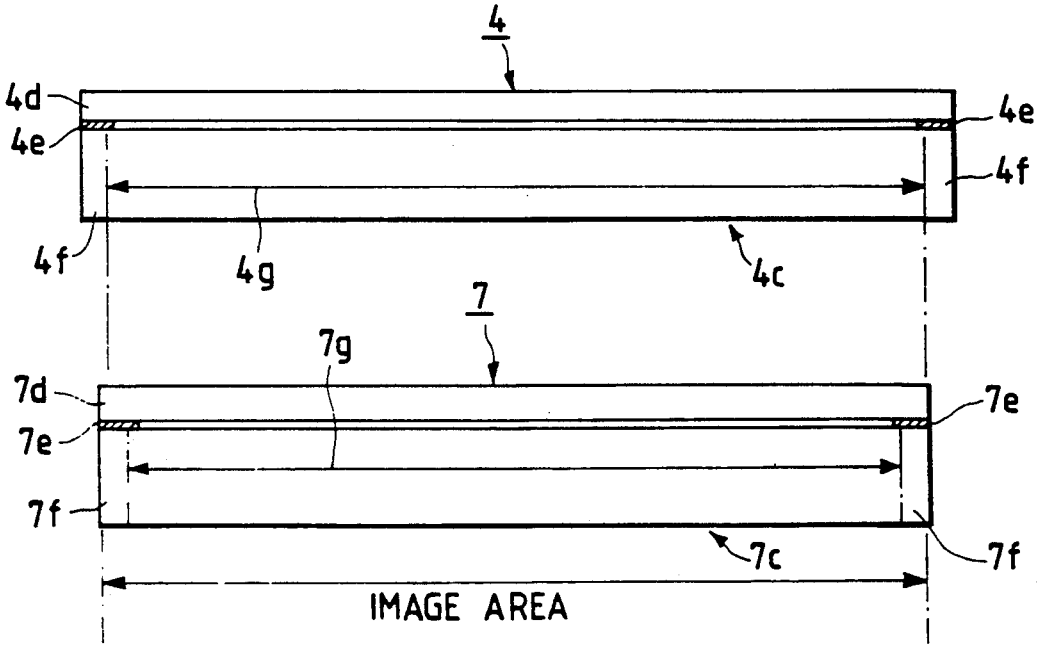
FIG. 20 is a front elevational view of a developing device according to another embodiment of the present invention, showing a relation between a blade for regulating a thickness of a developer layer, end seal members arranged on both ends of first and second developing sleeves, developer non-applying areas and developer carrying areas of the developing sleeves.

FIG. 20 shows a further embodiment of developing devices 4, 7 applicable to the present invention.

In this fourth embodiment, a developing sleeve 7c itself of a second developing device 7 is shorter than a developing sleeve 4c of a first developing device 4 and end seal members 4e, 7e and toner non-applying areas 4f, 7f have the same dimensions, respectively, so that a toner carrying area 7g of the second developing device 7 becomes shorter than a toner carrying area 4g of the first developing device 4.

Although the operation and the technical effect of the fourth embodiment is the same as those of the third embodiment, the fourth embodiment provides an advantage that the productivity is improved since the dimensions of the end zones (seals, toner non-applying areas) on the developing sleeves can be made the same.

Next, a fifth embodiment of the present invention will be explained.

Figure 21:
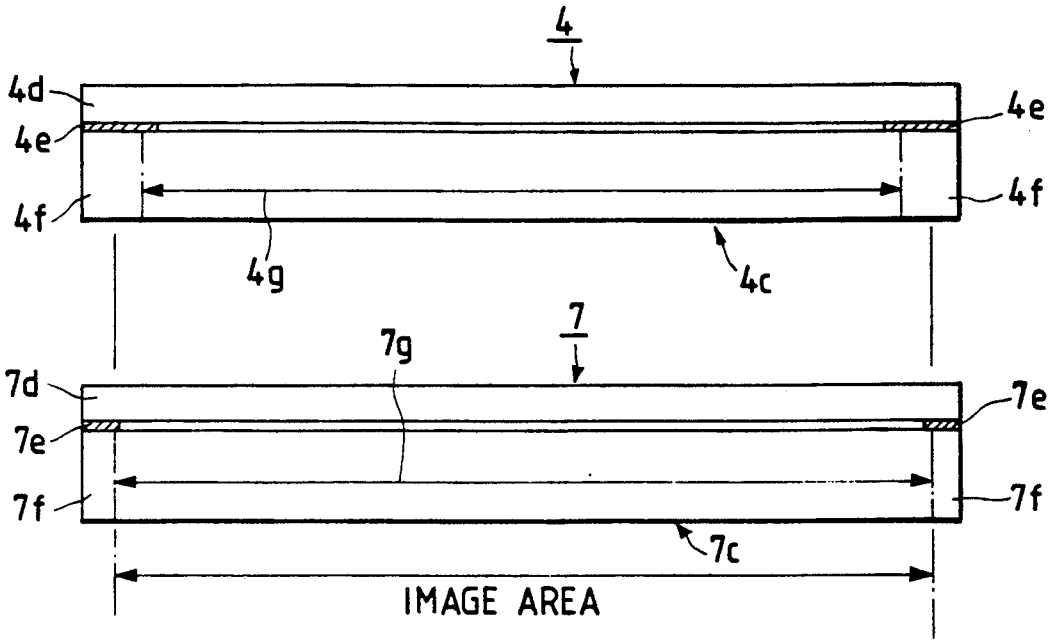
FIG. 21 is a front elevational view of a developing device according to a further embodiment of the present invention, showing a relation between a blade for regulating a thickness of a developer layer, end seal members arranged on both ends of first and second developing sleeves, developer non-applying areas and developer carrying areas of the developing sleeves.

FIG. 21 shows a still further embodiment of developing devices 4, 7 applicable to the present invention.

In this fifth embodiment, a first developing device contains two-component toner consisting of color toner and carrier, and a second developing device 7 contains black one-component magnetic toner.

As shown in FIG. 21, a longitudinal length of a toner carrying area 4g of the first developing device 4 containing the color toner is shorter than that of a toner carrying area 7g of the developing device 7 containing the black toner. With this arrangement, the same technical effect as that of the third embodiment can be achieved.

Further, according to the present invention, with respect to an image forming system utilizing three or more developing devices, by shortening longitudinal lengths of toner carrying areas of developing devices containing color toner in comparison with a longitudinal length of a toner carrying area of a developing device containing black toner, it is possible to provide a high quality multi-color image, as in the previous embodiments.

Figure 22:
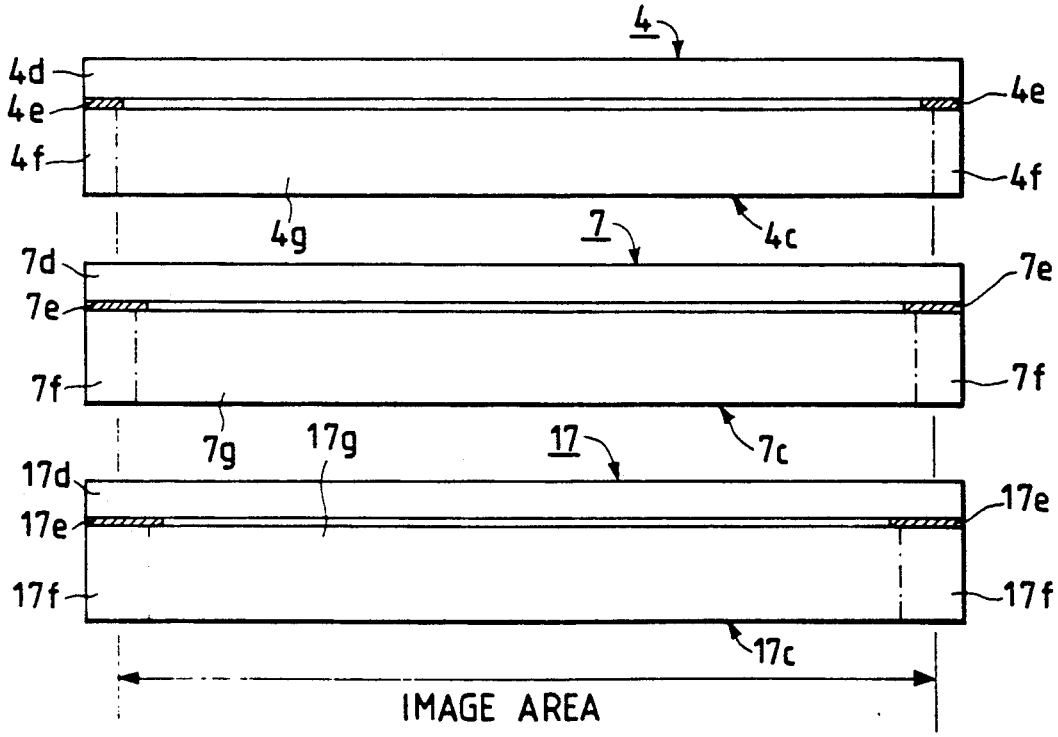
FIG. 22 is a front elevational view of a developing device according to a still further embodiment of the present invention, showing a relation between a blade for regulating a thickness of a developer layer, end seal members arranged on both ends of first to third developing sleeves, developer non-applying areas and developer carrying areas of the developing sleeves.

For example, FIG. 22 shows a sixth embodiment of a multi-color image forming system having three image forming processes (each including the charging, exposure, development) performed by the first and second developing devices 4, 7 constructed according to the present invention, and a third developing device 17 having the same construction as those of the first and second developing devices 4, 7, respectively. In this sixth embodiment, it is considered that a new image forming process comprising the charging, exposure and development is added to the second embodiment already explained in connection with FIG. 4, and, thus, three color images are formed on the photosensitive member during one revolution of the photosensitive member 1.

Referring to FIG. 22, the first, second and third developing devices 4, 7, 17 comprises toner layer thickness regulating blades 4d, 7d, 17d, seal members 4e, 7e, 17e provided on both ends of first, second and third developing sleeves 4c, 7c, 17c, toner non-applying areas 4f, 7f, 17f, and toner carrying areas 4g, 7g, 17g on the developing sleeves 4c, 7c, 17c, respectively.

With this arrangement, the first developing device 4 contains black one-component magnetic toner, the second developing device 7 contains red one-component non-magnetic toner and the third developing device 17 contains blue one-component non-magnetic toner.

In this sixth embodiment, similar to the first embodiment, after the first charging, the black image information is exposed by the first exposure to form a latent image, and then the latent image is developed with the black toner by the first developing device 4. In this case, as in the first embodiment, the developing bias voltage obtained by overlapping the AC voltage of 1300 Vpp, 2000 Hz to the DC voltage of +340 volts is applied to the developing sleeve 4c of the first developing device 4. Successively, similar to the first image forming process, a second image forming process comprising the charging, exposure and development in performed, and then a third image forming process comprising the charging, exposure and development is performed, thereby obtaining three black, red and blue images.

According to this embodiment, as shown in FIG. 22, the toner carrying areas 4g, 7g, 17g of the developing sleeves 4c, 7c, 17c are successively shortened in order. Thus, it is possible to prevent the second and third color toner from adhering to the end areas of the developing sleeves 7c, 17c and to prevent the black toner escaped from the end of the first developing device 4 from entering into the second and third developing devices 7, 17, thereby providing the high quality image having the good appearance without adhering the color toner to the peripheral zone of the image.

As mentioned above, according to the multi-color image forming systems of the second to fifth embodiments, since the longitudinal length of the toner carrying area of the toner carrying member of the developing device containing the color toner is shortened in comparison with the longitudinal length of the toner carrying area of the toner carrying member of the developing device containing the black toner, it is possible to prevent the color toner from adhering to the peripheral zone of the image, thus providing the high quality multi-color image.

Incidentally, since an end of a charging wire of the charger is likely to be smeared, the re-charger 5 disposed ahead of the second developing device is apt to be smeared with the first toner. Such contamination also causes the color toner to adhere to the peripheral zone of the image. If the color toner is adhered to the peripheral zone of the image, the image will have the bad appearance. However, according to the present invention, since the adhesion of the color toner to the peripheral zone of the image can be prevented, it is possible to such drawback.

Further, the first developing device usually containing the black toner is frequently used to obtain the most available image such as a black image, and, thus, the requirement for the image quality therefor is very severe. Accordingly, it is necessary to use the overlapped AC and DC voltages as the developing bias. By the way, the AC voltage tends to scatter the toner during the developing operation, and, particularly tends to scatter the toner from the end portions of the developing sleeve as the toner carrying member. However, the present invention can avoid such drawback.

Furthermore, although the seal members are arranged on both ends of the developing sleeves to prevent the leakage of the toner, the toner often escapes from the end of the developing sleeve out of the developing device. However, according to the present invention, the toner escaped from the end seal members of the first developing device can be prevented from entering into the other developing devices.

In addition, in the above embodiments, while the adjustment in the longitudinal direction (to which a rotation axis of the photosensitive member extends) of the photosensitive member was explained, an adjustment in a moving direction of the photosensitive member can be effected by adjusting the ON/OFF timing of the light image irradiation, ON/OFF timing of the developing bias and/or the relative position between the photosensitive member and the developing devices.

What is claimed is:

1. A color image forming apparatus, comprising:

an image carrier;

reading means for reading and for inputting color information for each color of a color original;

first latent image forming means for forming a latent image on the image carrier in accordance with color information corresponding to a black color input by said reading means;

first developing means for developing the latent image formed by said first latent image forming means using a black color developer;

second latent image forming means for forming a latent image on the image carrier of a color different from a black color in accordance with color information input by said reading means; and second developing means for developing the latent image formed by said second latent image forming means using a color developer different from a black color, wherein a second image area formed on the image carrier by said second latent image forming means and said second developing means is smaller than a first image area formed on the image carrier by said first latent image forming means and said first developing means.

2. An apparatus according to claim 1, wherein said first image area substantially corresponds to a width of the original read by said reading means, and said second image area is smaller than the width of the original.

3. An apparatus according to claim 1, wherein said second image area is located within said first image area.

4. An apparatus according to claim 1, wherein said second developing means effects reverse developing, and said second latent image forming means effects irradiation of a light onto said image carrier to form the latent image, and includes a shield member for interrupting the light irradiated onto an end portion of said image carrier by said second latent image forming means.

5. An apparatus according to claim 4, wherein said image carrier is movable, and said shield member is provided at both end portions of said image carrier in a perpendicular direction to the moving direction of said image carrier.

6. An apparatus according to claim 1, wherein said second developing means effects non-reverse developing, and said second latent image forming means effects irradiation of a light onto said image carrier to form the latent image, and irradiation of the light onto an end portion of said image carrier irrespective of the color information from said reading means.

7. An apparatus according to claim 6, wherein the end portion of said image carrier corresponds to an end of said first image area.

8. An apparatus according to claim 1, wherein said first developing means includes a first developer carrying member for carrying a developer, and said second developing means includes a second developer carrying member for carrying a developer, and an area in which said second developer carrying member deposited the developer is smaller than an area in which said first developer carrying member deposits the developer.

9. An apparatus according to claim 8, wherein said first developing means includes a first seal member for limiting the developer carrying area at an end portion of said first developer carrying member, said second developing means includes a second seal member for limiting the developer carrying area at an end portion of said second developer carrying member, and said second seal member is greater than said first seal member.

10. An apparatus according to claim 8, wherein said second developer carrying member has a length shorter than that of said first developer carrying member.

11. An apparatus according to claim 1, wherein said image carrier is movable, and said first and second developing means are arranged in a direction of the moving direction of said image carrier.

* * * * *